US009074842B2

(12) United States Patent
Merems

(10) Patent No.: US 9,074,842 B2
(45) Date of Patent: Jul. 7, 2015

(54) UMBILICAL CABLE DISCONNECT

(71) Applicant: Raytheon Company, Waltham, MA (US)

(72) Inventor: Paul A. Merems, Waltham, MA (US)

(73) Assignee: Raytheon Company, Waltham, MA (US)

( * ) Notice: Subject to any disclaimer, the term of this patent is extended or adjusted under 35 U.S.C. 154(b) by 259 days.

(21) Appl. No.: 13/675,925

(22) Filed: Nov. 13, 2012

(65) Prior Publication Data

US 2015/0153135 A1 Jun. 4, 2015

(51) Int. Cl.
*F41F 3/055* (2006.01)

(52) U.S. Cl.
CPC ..... *F41F 3/055* (2013.01)

(58) Field of Classification Search
CPC ..... F41F 3/055
USPC ..... 89/1.811, 1.14; 102/377; 244/137.4
See application file for complete search history.

(56) References Cited

U.S. PATENT DOCUMENTS

| | | | | |
|---|---|---|---|---|
| 2,870,676 | A | 1/1959 | Radkowski et al. | |
| 3,072,021 | A * | 1/1963 | Marcon | 89/1.811 |
| 3,122,403 | A * | 2/1964 | McKee et al. | 439/154 |
| 3,393,605 | A * | 7/1968 | Parnell | 89/1.14 |
| 3,518,613 | A * | 6/1970 | Alpert | 439/154 |
| 3,780,617 | A * | 12/1973 | Tabarie et al. | 89/1.811 |
| 3,991,649 | A * | 11/1976 | Patrichi | 89/1.14 |
| 4,047,464 | A * | 9/1977 | Fredriksson et al. | 89/1.811 |
| 4,438,675 | A * | 3/1984 | Fischer et al. | 89/1.811 |
| 6,460,445 | B1 * | 10/2002 | Young et al. | 89/1.51 |
| 7,026,540 | B1 * | 4/2006 | Doleski et al. | 114/20.1 |
| 7,575,456 | B2 * | 8/2009 | Cronin | 439/258 |
| 2010/0257983 | A1 * | 10/2010 | Jordan et al. | 83/13 |

OTHER PUBLICATIONS

PCT Application PCT/US2013/059521; filing date Sep. 12, 2013; Raytheon Company; International Search Report mailed May 27, 2014.

Cobham; Cable Cutters; www.cobham.COM/lifesupport; upon knowledge and belief prior to Aug. 14, 2012; 1 page; Cobham.

Ruckdeschel; Pyrotechnic cable cutter; http://www.roru.de/pyrotechnik/; upon knowledge and belief prior to Aug. 14, 2012; 2 pages (original German page and English translation); Rolf Ruckdeschel.

(Continued)

*Primary Examiner* — Bret Hayes

(57) ABSTRACT

An umbilical cable disconnect device is disclosed. The umbilical cable disconnect device includes a base having an opening configured to receive an umbilical cable, a cutter extending into the opening of the base, and a spacer component disposed in the opening between the cutter and the umbilical cable. The spacer component maintains separation of the cutter and the umbilical cable prior to disconnect of the umbilical cable. The cutter is operable to penetrate the spacer component in response to displacement of the disconnect device relative to the umbilical cable to facilitate cutting of the umbilical cable by the cutter to disconnect the umbilical cable.

20 Claims, 4 Drawing Sheets

(56) References Cited

OTHER PUBLICATIONS

SPOT4; Pyrotechnics; http://spot4.cnes.fr/spiot4_gb/pyro.html; upon knowledge and belief prior to Aug. 14, 2012; 2 pages (plus graphic from animation link); Centre National D'Etudes Spatiales.

US Army RDECOM; Hellfire Shotgun Connector Protector—R&M Improvement for Hellfire; http://www.amrdec.army.mil/amrdec/rdmr-se/ss/_hellfire _shotgun_connector.html ; 2012; 2 pages; U.S. Army RDECOM AMRDEC Engineering Driectorate.

* cited by examiner

UMBILICAL CABLE DISCONNECT

BACKGROUND

A vehicle, such as a missile or rocket, often includes an umbilical cable to provide power for the vehicle and/or a communication link to a computer or other electronic device on the vehicle prior to launch of the vehicle. An umbilical cable can include many different wires or traces, each one having a particular use, such as power or communication. An umbilical cable is used prior to launch of the vehicle and is severed or disconnected prior to, or concurrent with launch of the vehicle. Currently, umbilical cable disconnect is accomplished using an explosive (pyrotechnic) cable cutter and/or by separating mating connectors on the outside of a vehicle.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
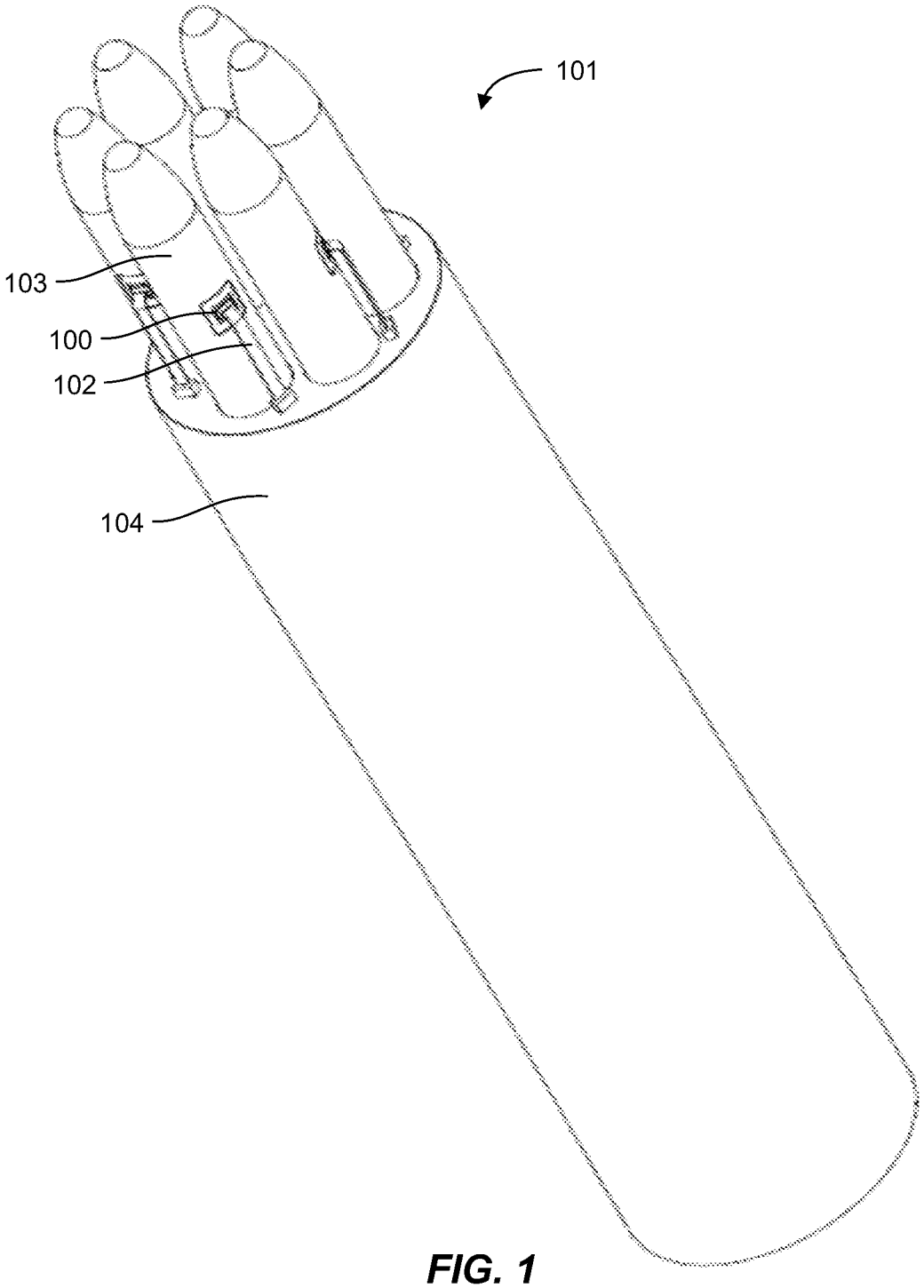
FIG. 1 is an example illustration of an umbilical cable disconnect device within an umbilical cable disconnect system in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected.

Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Typically, explosive (pyrotechnic) cable cutters and mating connectors on the outside of a vehicle are large in size and take up much needed interior space on the vehicle. In addition, such devices can protrude outside the vehicle, which can interfere with an adjacent vehicle on a launch platform and/or impact the aerodynamics of the vehicle. As vehicles become smaller in size, the need increases for a compact, lightweight, and low cost umbilical cable disconnect.

Accordingly, an umbilical cable disconnect device is disclosed that is relatively small, lightweight, and inexpensive. In one aspect, the umbilical cable disconnect device can function passively upon launch of the vehicle. The umbilical cable disconnect device can include a base having an opening configured to receive an umbilical cable, a cutter extending into the opening of the base, and a spacer component disposed in the opening between the cutter and the umbilical cable. The spacer component can be configured to maintain separation of the cutter and the umbilical cable prior to disconnect of the umbilical cable. The cutter can be operable to penetrate the spacer component in response to displacement of the disconnect device relative to the umbilical cable to facilitate cutting of the umbilical cable by the cutter to disconnect the umbilical cable.

In one aspect, an umbilical cable disconnect system is disclosed. The umbilical cable disconnect system comprises an umbilical cable, a cutter operable to cut the umbilical cable, and a spacer component disposed between the cutter and the umbilical cable. The spacer component maintains separation of the cutter and the umbilical cable prior to disconnect of the umbilical cable. The cutter is operable to penetrate the spacer component in response to displacement of the cutter relative to the umbilical cable to facilitate cutting of the umbilical cable by the cutter to disconnect the umbilical cable.

One embodiment of an umbilical cable disconnect device 100 is illustrated in FIG. 1. Aspects of the umbilical cable disconnect device 100, as described herein, can be included in an umbilical cable disconnect system 101. As shown, the system 101 can include an umbilical cable disconnect device 100, mounted about the side of a vehicle 103, and an umbilical cable 102, such that the disconnect device 100 is operable to disconnect the umbilical cable 102. In one aspect, the umbilical cable 102 can electrically couple the vehicle 103, such as a rocket, missile, warhead, or other kill vehicle, to a launch platform 104. For example, an end of the umbilical cable 102 can be coupled to the vehicle 103 and an opposite end of the umbilical cable 102 can be coupled to the launch platform 104. Thus, the umbilical cable 102 can electrically couple the vehicle 103 to the launch platform 104 prior to launch of the vehicle 103 and the umbilical cable disconnect device 100 can disconnect the umbilical cable 102 upon launch of the vehicle 103 from the launch platform 104. The umbilical cable disconnect device 100 can be used, for example, to sever an umbilical cable for tube or rail launched rockets and missiles, incorporated in gravity/eject launched vehicles, or on a multi-staged vehicle for disconnecting an umbilical cable at stage separation.

Figure 2A:
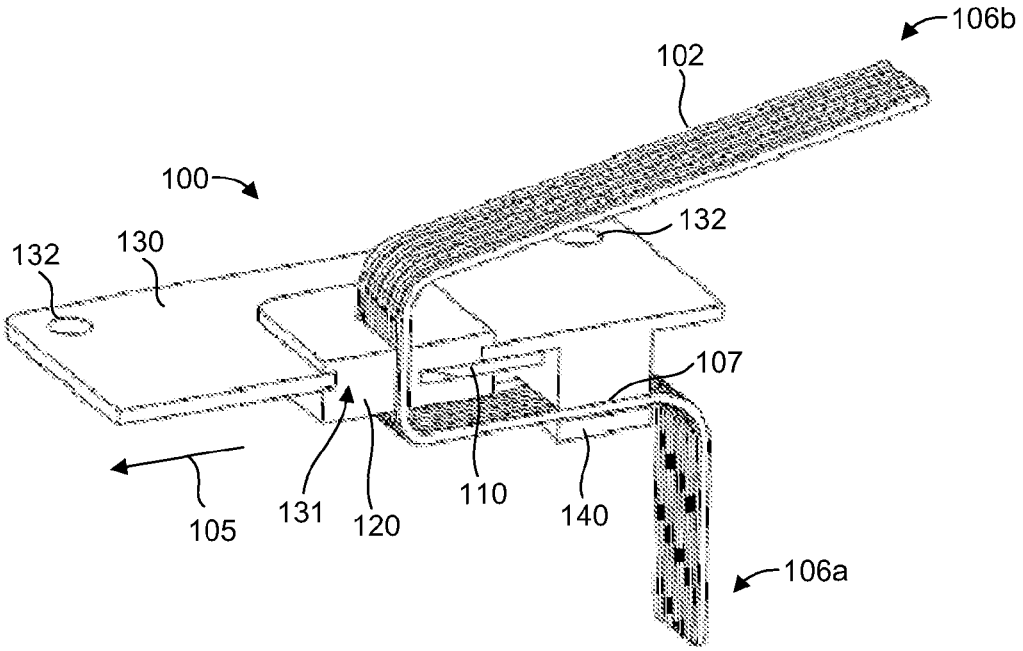
FIG. 2A is a close-up perspective view of the umbilical cable disconnect device of FIG. 1 in accordance with an embodiment of the present invention.
Figure 2B:
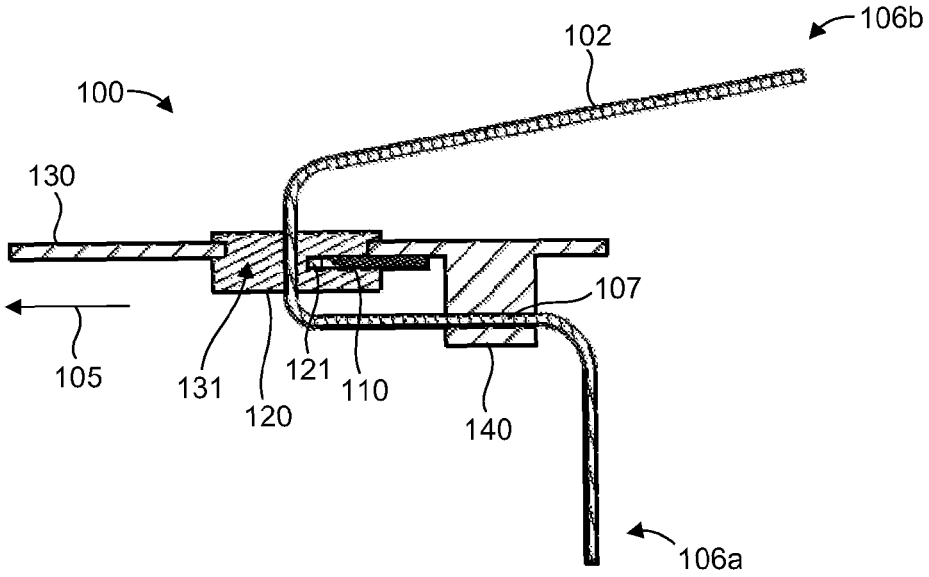
FIG. 2B is a side cross-sectional view of the umbilical cable disconnect device of FIG. 1.

With continued reference to FIG. 1, and as shown in more detail in FIGS. 2A and 2B, the umbilical cable disconnect device 100 can comprise a cutter 110 operable to cut the umbilical cable 102. In one aspect, the cutter 110 can comprise a non-metallic blade material to prevent a short circuit when cutting the umbilical cable 102. For example, as the cutter 110 cuts the umbilical cable 102, the cutter 110 can simultaneously contact two or more traces or wires within the umbilical cable, which can cause a short circuit. The likelihood of a short circuit of the umbilical cable 102 during severing or disconnect of the cable 102A can be prevented or minimized by utilizing a non-metallic blade material, such as a ceramic, an acrylic, or any other suitable non-metallic material. The cutter 110 can also include a straight-edge blade, a serrated-edge blade, or any other suitable blade type.

In another aspect, the umbilical cable 102 can be configured to minimize trace overlap to prevent a short circuit upon disconnect of the umbilical cable 102. For example, as the cutter 110 cuts the umbilical cable 102, the traces of the cable 102 can locally "smear" or deform. In some configurations, smeared or deformed traces can contact one another after being cut, causing a short circuit. In one aspect, critical traces, or those traces that can cause a short circuit, can be non-overlapping in the direction of the cut. Non-overlapping traces in the direction of the cut can minimize trace overlap or contact resulting from the cut and the local smearing or deformation of the traces, which can prevent the traces from causing a short circuit during or after severing or disconnect of the umbilical cable 102. As illustrated, the umbilical cable 102 can be configured as a ribbon cable having non-overlapping traces in the direction of cut (i.e., side by side) and the cutter 110 can be configured to cut roughly perpendicular to the width of the ribbon cable. It should be recognized that the umbilical cable disconnect device 100 can be used to disconnect or sever any cable or trace configuration, such as a round cable, a flat cable, or any other cable configuration. In one aspect, an umbilical cable of any given shape can have any arrangement of traces configured to avoid smearing traces together, which could short circuit the umbilical cable.

Figure 4A:
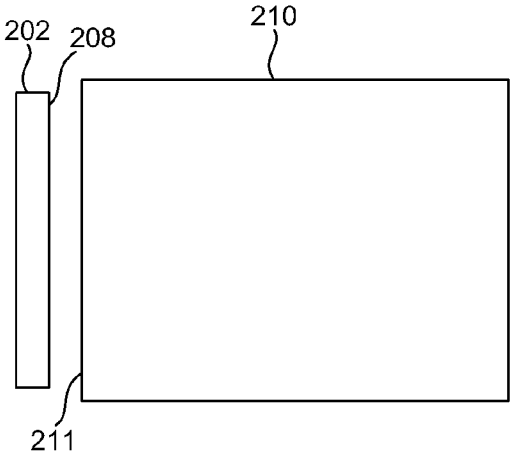
FIG. 4A is a top view of an umbilical cable and a cutter in accordance with an embodiment of the present invention.
Figure 4B:
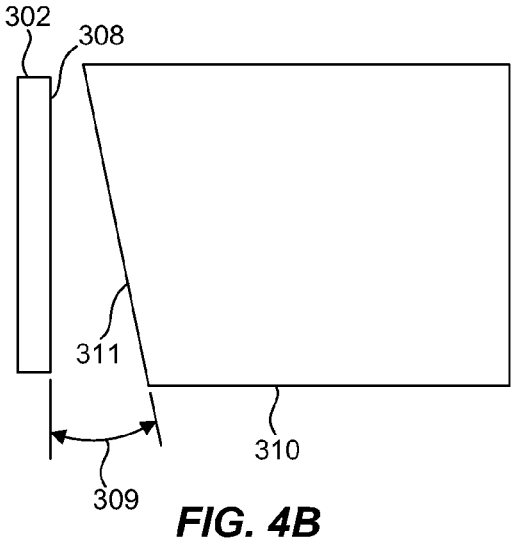
FIG. 4B is a top view of an umbilical cable and a cutter in accordance with another embodiment of the present invention.
Figure 4C:
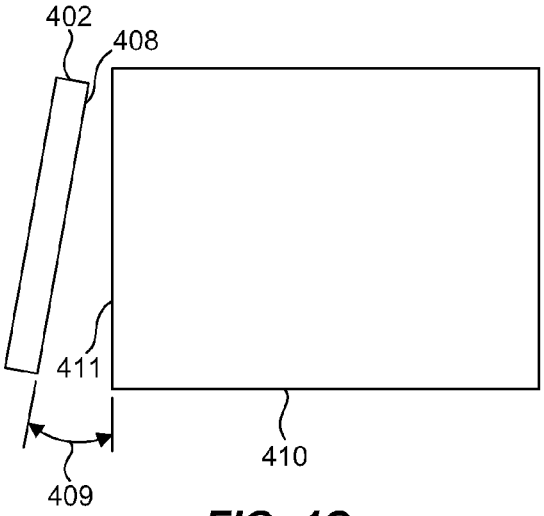
FIG. 4C is a top view of an umbilical cable and a cutter in accordance with yet another embodiment of the present invention.

A spacer component 120 can be disposed between the cutter 110 and the umbilical cable 102. The spacer component 120 can maintain separation of the cutter 110 and the umbilical cable 102 prior to disconnect of the umbilical cable 102. In other words, the spacer component 120 can prevent the umbilical cable 102 from contacting the cutter 110 during normal handling and prior to launch of the vehicle 103. For example, the spacer component 120 can be disposed about the cutter 110 and the umbilical cable 102 can extend through the spacer component 120. The spacer component 120 can help maintain a desired orientation of the umbilical cable 102 relative to the cutter 110, such as a proper cutting angle or cut relationship, examples of which are shown in FIGS. 4A-4C. For example, the orientation of the cutter 110 can be transverse to the portion of the umbilical cable 102 extending through the spacer component 120. In one aspect, discussed in more detail hereinafter, the spacer component 120 can comprise an elastomeric material, such as rubber.

The cutter 110 can be operable to penetrate the spacer component 120 in response to displacement of the cutter 110 (or the disconnect device 100) relative to the umbilical cable 102 in direction 105 to facilitate cutting of the umbilical cable 102 by the cutter 110 to disconnect the umbilical cable 102. In one aspect, displacement of the cutter 110 relative to the umbilical cable 102 can be caused by launching the vehicle 103 from the launch platform 104. Operation of the umbilical cable disconnect device 100 to disconnect the umbilical cable 102 can therefore be passive or responsive, and initiated by the launch of vehicle 103.

Figure 3A:
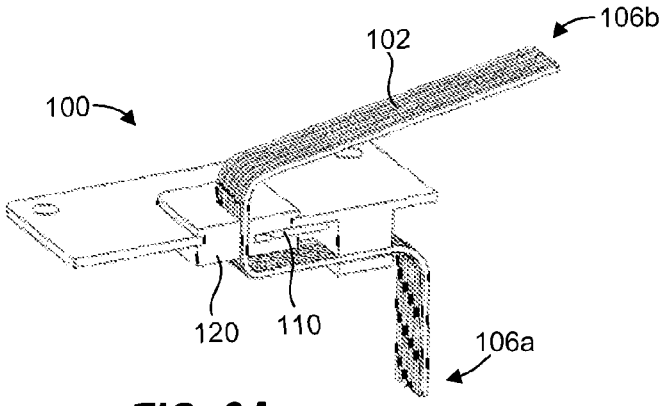
FIGS. 3A-3D are example illustrations of the umbilical cable disconnect device of FIG. 1 in use, in accordance with an embodiment of the present invention.
Figure 3B:
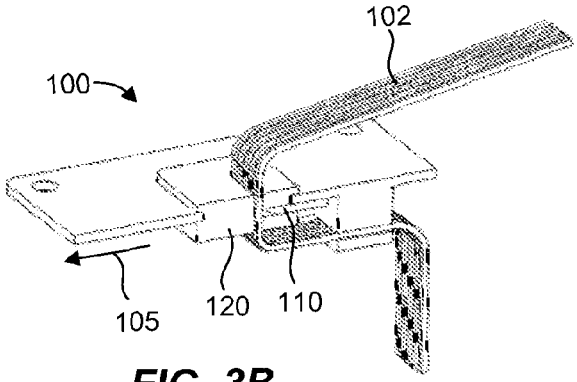
Figure 3C:
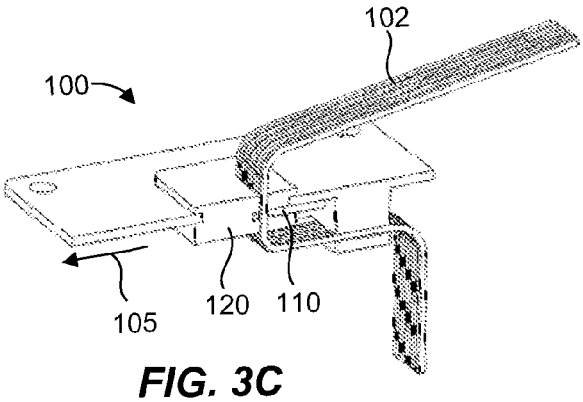

For example, and with continued reference to FIGS. 1-2B, FIGS. 3A-3D illustrate the umbilical cable disconnect device 100 in operation associated with the vehicle 103 and the launch platform 104. As shown in FIG. 3A, end 106*a* of the umbilical cable 102 can be coupled to the vehicle 103 and end 106*b* of the umbilical cable 102 can be coupled to the launch platform 104. The spacer component 120 can maintain separation of the cutter 110 and the umbilical cable 102 prior to initiation of the disconnect of the umbilical cable 102. As shown in FIG. 3B, the vehicle 103 can be configured to move in direction 105 when launched, such that tension is increased in the umbilical cable 102 as the vehicle 103 moves away from the launch platform 104. Initially, there may be no relative movement between the umbilical cable 102 proximate to the spacer component 120 and the cutter 110. As tension increases in the umbilical cable 102, however, the cutter 110 can penetrate the spacer component 120. In one aspect, the spacer component 120 can also deform or compress in response to the cutter 110, as the cutter 110 moves closer to the umbilical cable 102. The cutter 110 can continue penetrating the spacer component 120 until reaching the umbilical cable 102, as shown in FIG. 3C, at which point the cutter 110 can cut the umbilical cable 102.

Figure 3D:
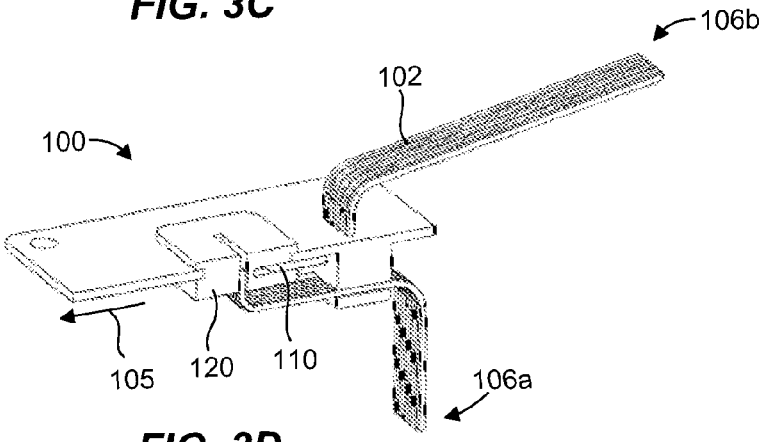

FIG. 3D illustrates a completed cut and disconnect of the umbilical cable 102, with end 106*a* of the umbilical cable 102 remaining with the vehicle 103 and end 106*b* of the umbilical cable 102 remaining with the launch platform 104. In one aspect, once the umbilical cable 102 is severed or disconnected, the spacer component 120 can elastically return to its original form, pulling the remaining portion of the umbilical cable 102 that is within the spacer component 120 away from the cutter 110. The resulting configuration of the umbilical cable disconnect device 100 can provide a minimally intrusive aerodynamic form, with the severed portion of the umbilical cable 102 secured inside the vehicle 103 and presenting no aerodynamic concerns.

Referring again primarily to FIGS. 1-2B, the umbilical cable disconnect device 100 can also include a clamp 140 to facilitate fixing at least a portion 107 of the umbilical cable 102 relative to the umbilical cable disconnect device 100. The clamp 140 can secure the umbilical cable 102 such that tension in the umbilical cable 102 between the vehicle 103 and the launch platform 104 does not cause damage or other otherwise adversely affect the vehicle 103, such as by pulling on electronic components or connections. The clamp 140 can therefore isolate internal components and/or connections in the vehicle 103 from tension in the umbilical cable 102 between the vehicle 103 and the launch platform 104.

In one aspect, the umbilical cable disconnect device 100 can include a base 130 having an opening 131 configured to receive the umbilical cable 102, such that the umbilical cable 102 extends through the base 130. The base 130 can be configured to be coupled to a body of the vehicle 103, such as with a fastener through one or more holes 132. In a particular aspect, the base 130 can serve as an access cover for the vehicle 103. The cutter 110 can extend into a periphery of the opening 131 of the base 130, which can facilitate contact between the cutter 110 and the umbilical cable 102 to disconnect the umbilical cable 102. The spacer component 120 can be molded around or otherwise disposed about the umbilical cable 102 and the cutter 110 to seal the opening 131 and, thus the body of the vehicle 103. The spacer component 120 can also be configured to resiliently flex to facilitate sealing of the opening 131 following disconnect of the umbilical cable 102.

Thus, the spacer component 120 can be configured to provide an environmental seal of the opening 131 around the umbilical cable 102 and to maintain such a seal before and after disconnect of the umbilical cable 102. As illustrated, the base 130 can be operable to support the cutter 110, the spacer component 120, and/or the clamp 140. It should be recognized, however, that the cutter 110, the spacer component 120, and/or the clamp 140 can be supported by a structure independent from the base 120.

As mentioned hereinabove, the spacer component 120 can be configured to compress upon displacement of the cutter 110 or disconnect device 100 relative to the umbilical cable 102. In other words, tension in the umbilical cable 102 can increase, which can cause the umbilical cable 102 to compress the spacer component 120. This can allow the umbilical cable 102 to move toward the cutter 110 to facilitate severing and disconnect of the umbilical cable 102.

The spacer component 120 can comprise a pre-formed piece, or a liquid material that sets up upon being disposed into the opening 131 of the base 130. In one aspect, the spacer component 120 can comprise a natural or a synthetic elastomeric material. The spacer component 120 material can be selected to effectively function as a seal in a desired temperature range, such that the spacer component can elastically deform to maintain the seal without being too stiff or too soft.

FIGS. 4A-4C illustrate schematic examples of various cutter and umbilical cable configurations. For instance, FIG. 4A illustrates a cutter 210 having a blade edge 211 that is substantially parallel to a flat side 208 of an umbilical cable 202, which can be configured as a ribbon cable or other cable having a flat side. In this configuration, the entire side 208 of the umbilical cable 202 can contact the blade edge 211 of the cutter 210 at substantially the same time. FIG. 4B, on the other hand, illustrates a cutter 310 having a blade edge 311 that is disposed at an angle 309 relative to a flat side 308 of an umbilical cable 302, which can be configured as a ribbon cable or other cable having a flat side. In this configuration, the blade edge 311 of the cutter 310 can progressively contact the side 308 of the umbilical cable 302 during the course of the cut, which can produce a lower cutting load on the umbilical cable 302 than in the example of FIG. 4A. The relative orientation of the cutter 210 and the umbilical cable 202 in FIG. 4A and the relative orientation of the cutter 310 and the umbilical cable 302 in FIG. 4B are substantially the same. The difference is the angle 309 built into the blade 311 of the cutter 310. As with the angled blade edge 311 shown in FIG. 4B, FIG. 4C illustrates a cutter 410 having a blade edge 411 that can progressively contact the flat side 408 of an umbilical cable 402 during the course of the cut. In this example, however, relative orientation of the blade edge 411 and the umbilical cable 402 is such that the flat side 408 is disposed at an angle 409 relative to the blade edge 411. As mentioned above, the separation component 120 can serve to maintain the umbilical cable 102 and the cutter 110 in a desired cutting orientation relative to one another. It should also be recognized that the cutter can be wider than the umbilical cable to ensure a complete cut of the cable.

In accordance with one embodiment of the present invention, a method for facilitating disconnect of an umbilical cable is disclosed. The method can comprise obtaining an umbilical cable. The method can also comprise obtaining a cutter operable to cut the umbilical cable. The method can further comprise disposing a spacer component between the cutter and the umbilical cable, wherein and the spacer component maintains separation of the cutter and the umbilical cable prior to disconnect of the umbilical cable. Additionally, the method can comprise facilitating displacement of the cutter relative to the umbilical cable, wherein the cutter is operable to penetrate the spacer component to facilitate cutting of the umbilical cable by the cutter to disconnect the umbilical cable. It is noted that no specific order is required in this method, though generally in one embodiment, these method steps can be carried out sequentially.

In one aspect, the method can further comprise coupling an end of the umbilical cable to a vehicle and an opposite end of the umbilical cable to a launch platform. In a specific aspect, facilitating displacement of the cutter relative to the umbilical cable can comprise facilitating launch of the vehicle from the launch platform.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. An umbilical cable disconnect device, comprising:

abuse having an opening configured to receive an umbilical cable;

a cutter extending into the opening of the base; and a spacer component disposed in the opening between a cutting edge of the cutter and the cable, wherein the spacer component maintains separation of the cutter and the umbilical cable prior to disconnect of the umbilical cable, and wherein the cutter is operable to penetrate the spacer component in response to displacement of the disconnect device relative to the umbilical cable to facilitate cutting of the umbilical cable by the cutter to disconnect the umbilical cable.

2. The umbilical cable disconnect device of claim 1, wherein the base is operable to support the cutter.

3. The umbilical cable disconnect device of claim 1, wherein the base is operable to support the spacer component.

4. The umbilical cable disconnect device of claim 1, further comprising a clamp to facilitate fixing at least a portion of the umbilical cable thereto.

5. The umbilical cable disconnect device of claim 4, wherein the base is operable to support the clamp.

6. The umbilical cable disconnect device of claim 1, wherein the spacer component configured to resiliently flex to facilitate sealing of the opening following disconnect of the umbilical cable.

7. The umbilical cable disconnect device of claim 1, wherein the spacer component is configured to compress upon displacement of the disconnect device relative to the umbilical cable.

8. The umbilical cable disconnect device of claim 1, wherein the cutter comprises a non-metallic blade material to prevent shorting when cutting the umbilical cable.

9. The umbilical cable disconnect device of claim 1, wherein the cutter comprises a straight-edge blade.

10. The umbilical cable disconnect device of claim 1, wherein the cutter comprises a serrated-edge blade.

11. An umbilical cable disconnect system, comprising:

an umbilical cable;

a cutter adjacent the umbilical cable, the cutter being operable to cut the umbilical cable; and a spacer component disposed between a cutting edge of the cutter and the umbilical cable, wherein the spacer component maintains separation of the cutter and the umbilical cable prior to disconnect of the umbilical cable, and wherein the cutter is operable to penetrate the spacer component in response to displacement of the cutter relative to the umbilical cable to facilitate cutting of the umbilical cable by the cutter to disconnect the umbilical cable.

12. The system of claim 11, wherein the umbilical cable is configured minimize trace overlap to prevent shorting the umbilical cable upon disconnect.

13. The system of claim 11, wherein the umbilical cable is configured as a ribbon cable.

14. The system of claim 13, wherein a cutting edge of the cutter is disposed at an angle relative to a wide side of the ribbon configuration of the umbilical cable.

15. The system of claim 11, further comprising a vehicle and a launch platform, wherein an end of the umbilical cable is coupled to the vehicle and an opposite end of the cable is coupled to the launch platform.

16. The system of claim 15, wherein displacement of the cutter relative to the umbilical cable is caused by launching the vehicle from the launch platform.

17. The system of claim 15, further comprising a base coupled to a body of the vehicle and having an opening configured to receive the umbilical cable.

18. A method for facilitating disconnect of an umbilical cable, comprising:

obtaining an umbilical cable;

disposing a cutter adjacent the umbilical cable, the cutter being operable to cut the umbilical cable;

disposing a spacer component between a cutting edge of the cutter and the umbilical cable, wherein and the spacer component maintains separation of the cutter and the umbilical cable prior to disconnect of the umbilical cable; and facilitating displacement of the cutter relative to the umbilical cable, wherein the cutter is operable to penetrate the spacer component to facilitate cutting of the umbilical cable by the cutter to disconnect the umbilical cable.

19. The method of claim 18, further comprising coupling an end of the umbilical cable to a vehicle and an opposite end of the umbilical cable to a launch platform.

20. The method of claim 19, wherein facilitating displacement of the cutter relative to the umbilical cable comprises facilitating launch of the vehicle from the launch platform.

* * * * *